United States Patent [19]

Wilcox, Jr.

[11] 4,228,996

[45] Oct. 21, 1980

[54] AUTOMATIC SHEET COLLATOR

[76] Inventor: Earl H. Wilcox, Jr., 1208 Windsor Rd., Florence, S.C. 29501

[21] Appl. No.: 76,468

[22] Filed: Sep. 17, 1979

[51] Int. Cl.[3] ..... B65H 31/24

[52] U.S. Cl. ..... 271/297; 271/305

[58] Field of Search ..... 271/287, 297, 303, 305; 270/58

[56] References Cited

U.S. PATENT DOCUMENTS

| | | | |
|---|---|---|---|
| 1,203,261 | 10/1916 | Powers | 271/305 |
| 3,877,693 | 4/1975 | Gerbracht | 271/297 |
| 4,095,782 | 6/1978 | Breuers et al. | 271/297 |

*Primary Examiner*—Robert W. Saifer

*Attorney, Agent, or Firm*—Shoemaker and Mattare

[57] ABSTRACT

A collator which utilizes sheet momentum to operate sheet diverting vanes includes over-center weight elements in the vanes. The vanes are rockably positioned to block and open a sheet conveyance path, and force exerted on the vane by the sheet and the over-center weight element as a sheet moves into a collection compartment tips the vane from a sheet diverting, path blocking position to a path freeing position.

11 Claims, 6 Drawing Figures

AUTOMATIC SHEET COLLATOR

BACKGROUND OF THE INVENTION

The present invention relates in general to sorters, and, more particularly, to collators.

Collating many sheets is one of the most time consuming and onerous tasks performed in many offices. This problem is commonly associated with distributing copies of reports or the like to individuals in many departments; however, the problem is not limited to copies only and may occur in other contexts as well.

There are many solutions to the problem of collating a large number of sheets, such as, for example, the sorting machine disclosed in U.S. Pat. No. 3,937,459, which uses solenoid operated finger units to deploy sheets into appropriate compartments, U.S. Pat. No. 3,841,754, which discloses motor operated gates, U.S. Pat. No. 4,095,782, which discloses a guide element controlled by a spring-locking element mechanism, and U.S. Pat. No. 3,774,902, which discloses a sheet separator using a deflecting bar mounted on a belt which is moved by a stepping motor according to a predetermined sequence.

While these devices are improvements over hand collating, they all suffer the disadvantage of including several, if not many, elements. Often these elements include complex electrical or mechanical elements themselves. A large number of elements, or elements that are complex, increases the possibility of failure, increases the difficulty of repair and thereby decreases the efficiency and desirability of a device.

Accordingly, there is need for a collating device that is simple to build, use and service. Such a device also should include no elaborate or complex mechanisms, either mechanical or electrical.

A further drawback to known devices, such as those discussed above, is the requirement that count devices or sheet length control and monitoring devices be included. The timing systems of such known devices operate independently of sheet length, and thus must be reset for a change in sheet length.

Thus, there is need for a collating device which is simple in operation and yet can operate without count control or length control elements.

SUMMARY OF THE INVENTION

The collator embodying the teachings of the present invention is simple to operate, has simple elements and automatically sorts/organizes sheets as those sheets are ejected from a machine such as a copier.

The collator embodying the teachings of the present invention utilizes the momentum of a moving sheet to move a sheet diverting vane from a tilted sheet diverting orientation into an upright position. The collator utilizes a sheet flow which is downwardly directed and employes the gravity-induced momentum of such sheets to operate sheet diverting means. As such, gravity is used to assist in the collating operation.

A sheet diverting vane is situated adjacent a sheet flow path and the tilted vane blocks, or occludes, that path when in the tilted orientation so that sheets impact the vane and are diverted into a sheet collecting compartment associated with the vane. The upright vane has a bypass path therearound in the sheet flow path so a sheet bypasses the upright vane and the compartment associated with such upright vane. There are a plurality of vertically spaced vanes which are sequentially actuated in a progressively downward direction as successive sheets are fed into a chute defining the sheet flow path. The sheets are thus sequentially deflected into various compartments in a downwardly successive manner by the collator vanes.

Each vane is rockably mounted and includes a movable weight located therein near the rocking axis thereof so that each vane is operated in an over-center manner. That is, as the sheet passes over the vane into the associated bin, that sheet tilts the vane toward the bin far enough to cause the movable weight to move across the pivot axis of the vane and thus reposition the center of gravity of the vane. This shift in vane center of gravity position causes the vane to rock toward the bin and close behind the sheet securely, but with enough delay to allow that sheet to pass over the vane without being trapped thereby.

A next successive sheet entering the chute passes by the just-discussed closed bin, and is deflected into the next lower bin by the open/waiting vane associated with that next lower bin. The process is repeated for all of the sheets to be collated or for as many bins as there are in a unit. If the process is to be repeated, an operator resets the vanes back into the tilted chute blocking orientations using a reset mechanism. The resetting of the vanes moves the weights back into the vane tilting positions.

The collator of the present invention is simple to use, and simple to build. There are no elaborate gears, motions, solenoids, belts, sensors or the like, and thus the device is very reliable and still easy to service when necessary.

The collator of the present invention does not need a count setup or a length control for sheets of varying size and length. The device of the present invention is, thus, very simple, economical and reliable as compared to known units.

OBJECTS OF THE INVENTION

It is, therefore, a main object of the present invention to provide a collator which is simple to build, operate and service.

It is another object of the present invention to provide a collator which is reliable.

It is still another object of the present invention to provide a collator which does not require a count setup.

It is yet another object of the present invention to provide a collator which does not require a length control when operating with varying length sheets.

It is a further object of the present invention to provide a collator which can accommodate varying lengths of sheets during the same run without alteration of the collator.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
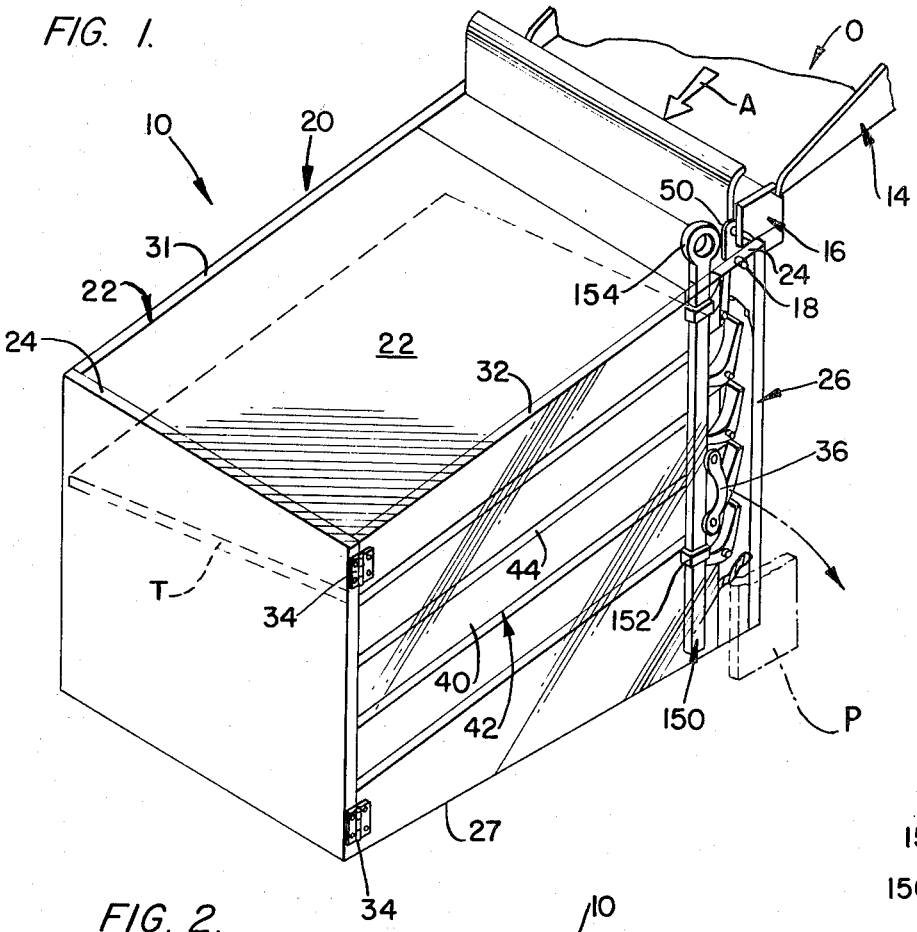
FIG. 1 is a perspective view of a collator embodying the teachings of the present invention.

Shown in FIG. 1 is a collator 10 which is attached to an outlet station O of a source of sheets to be sorted, such as a copying machine, or the like. The collator 10 is pivotally attached to an exit apron 14 by a pair of mounting brackets 16 having a pivot rod 18 attached thereto. The collator 10 is thus portable and can be attached to the apron 14 whenever necessary.

The collator 10 includes a housing 20 having a top 22, a front wall 24 which can serve as a jogging board if so desired, a back wall 26, and a bottom 27. The back wall is located subjacent the exit end of the apron 14 and includes a rear element 28 and a pair of side walls 30 and 30' attached thereto and extending in spaced parallelism toward the front wall 24 as best shown in FIGS. 1 and 3. A first side 31 is coplanar with side wall 30' of the rear wall and is attached to the front wall by any suitable means. If suitable, the collator 10 can have an open bottom and can rest on a support surface S as shown in FIG. 2 and can have any suitable length.

A translucent door 32 is optional, and, if used, can be connected to front wall 24 by hinges 34 and has a handle 36 thereon. The translucent door can be plexiglass or other such material, and permits viewing of and access to ganged sheet-receiving compartments 40 of catch or collecting trays 42. The side wall 31 can also be translucent and can also be an access door similar to door 32 if so desired. The compartments are preferably tilted and the door 32 is optional and can be used with or without the tilted configuration. The compartments form spaced vertically successive bins for receiving collated sheets, and each compartment has a bottom defining plate 44 which has an upper surface 45 and which is downwardly sloped to front wall 24 to direct the sheets received in each compartment toward the jogging board for proper stacking of the sheets in each compartment. As shown in FIGS. 1 and 2, the compartments are all parallel and are all downwardly sloped in a preferred embodiment, and are preferably tilted downwardly to the rear for stacking approximately 10° to 15° to the left or right as viewed in FIG. 1. The tilt is indicated in FIG. 1 by phantom lines T. The tilted orientation of the compartments stacking without a door, such as door 32. Fillers can also be used. If the door 32 is omitted, a clear side plate, of plexiglass or the like, can be used to cover the side vanes only. That is, a cover plate is positioned where side wall 30 is located. This cover plate is indicated in phantom lines in FIG. 1 and denoted by reference indicator P.

The collator 10 will now be described in greater detail with reference to FIG. 2. Sheet feed direction is indicated in FIGS. 1 and 2 by the arrows A and A' respectively, and the collator includes a sheet deflector 46 attached to the collator housing back wall sides 30 and 30' by a pair of mounting flanges 48 and a mounting rod 50 extending therebetween. The sheet deflector can pivot about rod 50 to be set up when the collator is in use and to be moved against top 22 when the collator is not in use. As shown in FIG. 2, each tray bottom defining plate 44 has a rear edge 56 attached to the housing walls 30 and 30' by mounting plates 58 and spaced from the housing back wall element 30. The plates 58 can be replaced by shelves, if so desired. The rear edges 56 of all of the tray bottom defining plates are vertically aligned and thus a sheet downcomer chute 60 is defined between the rear edges 56 and inner surface 62 of the housing back wall element 30.

Figure 2:
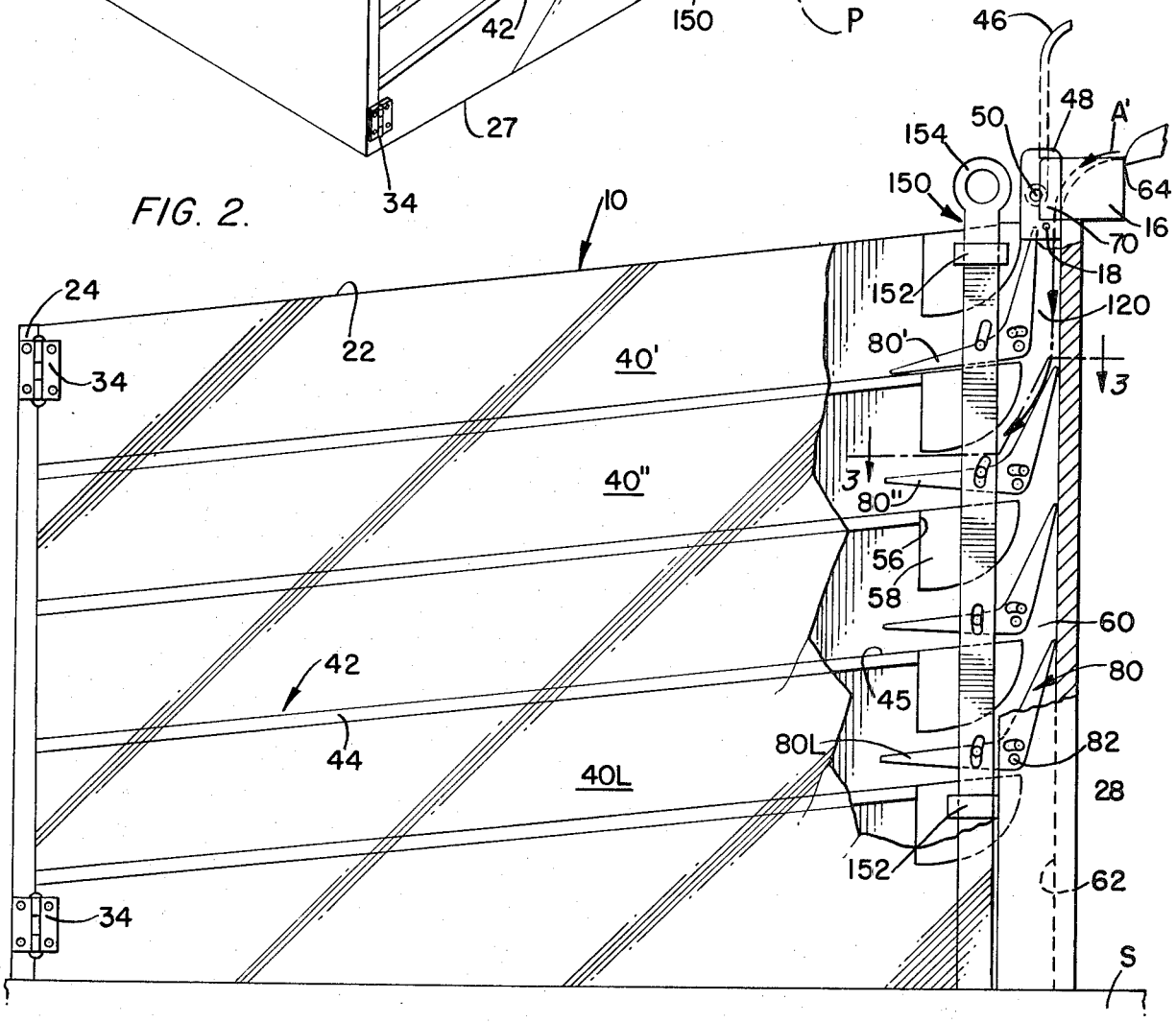
FIG. 2 is a partially cutaway side elevation of a collator embodying the teachings of the present invention.
Figure 3:
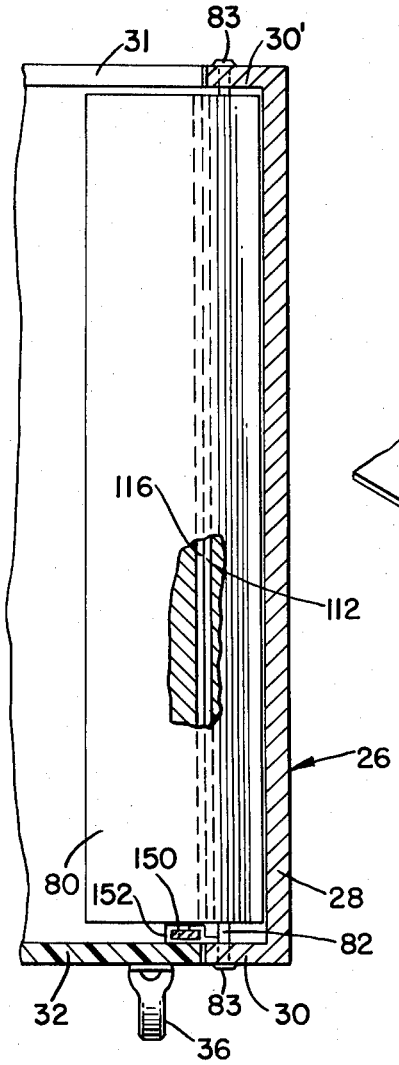
FIG. 3 is a view taken along line 3—3 of FIG. 2.

The deflector 46 and exit tip 64 of the apron 14 define an entranceway 70 to the downcomer chute 60, and sheets moving over the apron 14 are directed by the deflector into the downcomer chute as indicated by arrow A' in FIG. 2. The entranceway and the downcomer chute form the path of conveyance of sheets to be collected.

Figure 4:
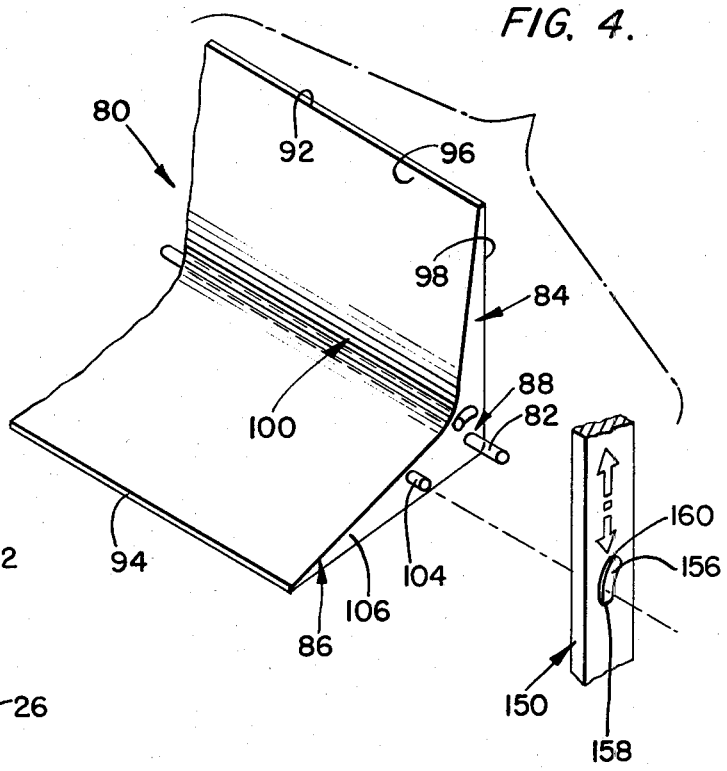
FIG. 4 is a perspective view showing a sheet diverter vane used in the collator embodying the teachings of the present invention.
Figure 5:
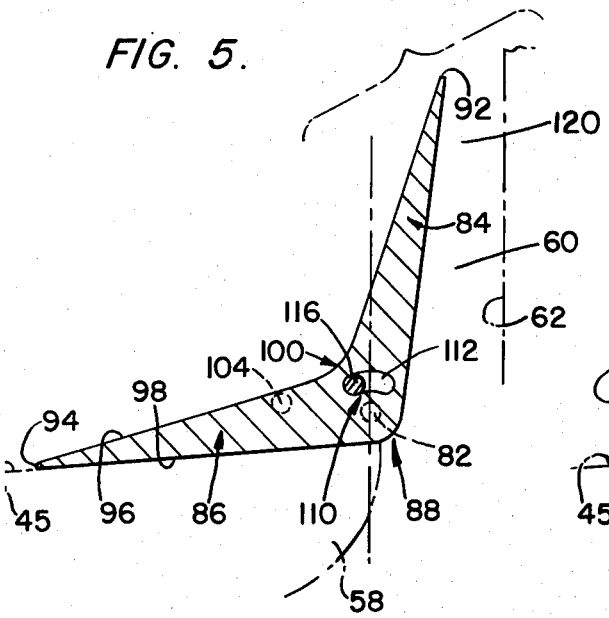
FIG. 5 is a side elevation view of a sheet diverter vane in an upright sheet path freeing orientation.
Figure 6:
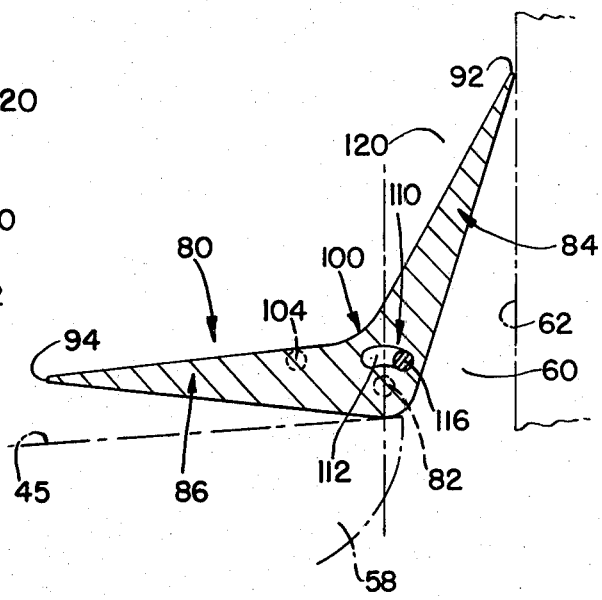
FIG. 6 is a side elevation view of a sheet diverter vane in a tilted sheet diverting orientation.

A plurality of sheet diverter vanes, hereinafter referred to as flippers 80, are each rockably mounted on the housing walls 30 and 30' by a pintle rod 82 to control movement of sheets diverted into the downcomer chute 60 via the entranceway 70. The pintle rod has knobs 83 thereon to attach that rod to the housing sides as best shown in FIG. 3. A flipper is best shown in FIGS. 4–6, and attention is directed thereto for a description of such flipper. Each flipper is elongate and is essentially V-shaped in transverse cross-section. Each flipper has a pair of arms 84 and 86 extending outwardly from a base portion or apex 88 to tips 92 and 94 which are hereinafter referred to as leading and trailing tips respectively. In a preferred embodiment, each arm has a planar inner surface 96 and a planar outer surface 98, and a central portion 100 of the flipper adjacent the vertex section is arcuate on both the inner and outer surfaces thereof to smoothly connect the planar portions to form a continuous profile. The inner contour of the flipper is concave and the arms intersect to form an angle which is selected according to constraints which will be apparent to those skilled in the art from the following discussion. As shown, each flipper has the thickest portion thereof located in the apex area and the arms have a tipwise decreasing thickness. Alternatively, the surfaces 96 and 98 can be curved or contoured as suitable, as will be later described.

The angle formed by the flipper inner surfaces is preferably an obtuse angle, that is an angle between 90° and 100°, and the flippers are formed of any suitable material suitable for such applications.

A guide pin 104 is mounted on side edge 106 of each flipper to project outwardly toward the housing side wall 30. The function and operation of this guide pin will be discussed below. Each flipper has a counterweight element 110 contained therein. As shown in FIGS. 4–6, in the preferred embodiment, the counterweight element includes an arcuate keeper chamber 112 defined in the apex portion of each flipper to extend longitudinally thereof. While the keeper chamber 112 is shown as being arcuate, as will be discussed below, that chamber can also be straight. The arcuate chamber 112 is curved about the pintle 82 and is located to be disposed closer to the leading tip 92 than to tip 94. The counterweight element 110 preferably includes a cylindrical bar 116 extending for essentially the entire length of the flipper and having an outer diameter slightly less than the inner diameter of the keeper chamber 112 to permit free movement of the bar 116 within the keeper chamber. Thus, the bar is freely movable from a first position shown in FIG. 5 closer to the tip 94 than to the tip 94 and between the pintle and the leading edge as shown in FIG. 6.

As aforediscussed, the flipper 80 is rockably mounted in the housing by the pintle 82, and the apex section of the flipper is the thickest part thereof. The center of gravity of the flipper is thus located at or very near the pintle 82, and this center of gravity can be adjusted to account for the material removed to define the chamber 112. However, the bar 116 has a weight selected to counter the weight of the flipper. Thus, when the bar is in the FIG. 5 position, that bar is located on the trailing arm side of the pintle and the center of gravity of the flipper is located between the trailing tip 94 and the pintle 82, and the flipper assumes a first position which will hereinafter be referred to as upright. However, when the bar 116 is in the FIG. 6 position on the other side of the keeper chamber 112, that bar is on the leading arm side of the pintle and the center of gravity of the flipper is shifted so that the pintle 82 is located between the center of gravity and the trailing tip 94, and the flipper assumes a second position which will hereinafter be referred to as upset.

By comparing FIGS. 2, 5 and 6, it is seen that the flippers are each associated with a compartment 40 and are mounted superjacent each bottom plate end edge 56 and the leading arms 84 thereof are sized to be longer than the width of the downcomer chute 60. The leading arms are located to extend into the chute 60, and the trailing arms are located superjacent the bottom plates 44. Thus, by referring to FIGS. 2, 5 and 6, it is seen that abutting contact between the flipper leading tip 92 and the back wall to the tip 92, and between the pintle and the trailing edge, across a rocking axis of the flipper as defined by the pintle 82 to a second position closer to the tip 92 than inner surface 62 prevents an upset flipper from pivoting completely around the pintle in the clockwise direction and abutting contact between the flipper trailing arm outer surface 98 and the bottom plate top surface 45 prevents the upright flipper from pivoting completely around the pintle in the counterclockwise direction.

As shown in FIGS. 2, 5 and 6, when a flipper is in the upset direction (FIG. 6), the leading arm extends across the downcomer chute 60 to occlude that chute and thus divert sheets moving in that path, and when that flipper is in the upright position (FIG. 5), the leading arm is spaced from the inner surface 62 and thus defines a bypass passageway 120 adjacent the upright flipper so the flipper is in a sheet path freeing position.

The angle of the flipper, the length and thickness of the leading arm, and the like are selected so that sheets to be collated will pass freely and easily past an upright flipper via the bypass 120. However, as shown in FIG. 2, when the flipper is in the FIG. 6 upset orientation, the leading arm occludes the chute 60, and a sheet passing through that chute in the direction of arrow A' in FIG. 2 will impact the flipper leading arm. The angle of the flipper, the angle of the planar surface 96 on the leading arm with respect to the vertical, the material of the flipper, and the like, are selected to deflect such a sheet toward the compartment associated with such flipper.

The weight of the bar 116, the distance of the chamber 112 from the pintle 82, the arcuate length of that chamber and the like are selected so that the weight of the sheet being deflected into a compartment by a flipper is sufficient to shift the flipper toward the FIG. 5 upright position from the FIG. 6 deflecting position so that the bar 116 moves in the chamber 112 across the pivot axis of the flipper sufficiently to move the center of gravity of the flipper to a position rearward (that is, toward the trailing tip side) of the pintle and thereby shift the flipper into the FIG. 5 upright orientation. The flipper thus have an over-center movement wherein the balance, location, and the like of the flipper are selected so that impact of a sheet to be diverted out of the chute 60 into an appropriate compartment is effected to smoothly divert that sheet without damage thereto, and so that the movement of such a sheet over the trailing arm of the flipper effects an uprighting movement so that flipper at a time when the sheet is far enough into the compartment so that no damage to the sheet results, and so that there will be a complete diversion of the sheet into the compartment with no portion of the sheet trailing edge being jammed between the flipper and a superjacent structure whereby jamming of the chute may result. The flippers can be balanced so that the uprighting movement thereof is timed to give a small impulse to the diverted sheet whereby the sheet is pushed positively toward the other end of the compartment to assist in the proper stacking of the sheets stored in each compartment.

A flipper uprighting bar 150 is slidably mounted on the inside of the housing wall 30 by a plurality of vertically spaced bands 152. The bar is elongate and has the longitudinal dimension thereof vertically oriented. The bar has a pull ring 154 on the upper end thereof, and has a plurality of arcuate guide slots 156 defined therein. Each of the guide slots receives a guide pin 104 of each flipper. The guide slots have an arcuate length selected so that the guide pin is located at one end 158 thereof when the flipper is in the FIG. 5 upright position, and at the other end 160 thereof when the flipper is in the FIG. 6 upset position. The uprighting bar is thus a flipper resetting mechanism to reset the upright flippers into the tilted, downcomer chute occluding position. The sizes of the guide slots and guide pins are selected to permit free movement of the pins in the slots such that flipper rocking movment is not impeded by the resetting mechanism.

Operation of the collator 10 is evident to those skilled in the art from the foregoing description, and can best be seen in FIG. 2. To initiate operation the resetting mechanism is actuated to tilt all of the flippers into the FIG. 6 upset orientation. A first sheet will contact the topmost flipper 80' and thereby be diverted into the topmost compartment 40'. As the sheet passes into the compartment 40', the over-center mechanism of the flipper 80' is actuated by the sheet to unbalance the flipper into an uprighting mode. The flipper then assumes an upright, downcomer chute unblocking orientation with a bypass 120 defined thereadjacent. The next following sheet then bypasses the topmost flipper 80' via the bypass 120 and impacts the next lower flipper 80'' to be diverted into the compartment 40'' associated therewith.

The just-discussed procedure is continued sequentially uprighting successively lower flippers until the lowermost flipper 80L is uprighted by diverting a sheet into the bin 40L associated therewith. Prior to another sheet entering the entranceway 70, the flipper resetting mechanism is actuated by pulling the resetting bar 150 upward, thereby upsetting all of the flippers back into the sheet diverting position. Resetting the flippers, of course, moves the bars 116 back into the first vane-tilting orientation. This process is repeated until all of the sheets are collated into the appropriate bins of the collator 10.

The door 32, or other such access means, can then be opened to provide access to the compartments for removing the collated sheets.

One embodiment of the flipper includes a trailing arm which is $1\frac{1}{8}$ inches long and has a straight keeper chamber extending from surface 96 of leading arm 84 at an angle of about 80° with respect to that surface for substantially the entire thickness of that arm to a location slightly spaced from rear surface 98 of that arm. The keeper chamber in this embodiment is located about $\frac{1}{8}$ inch from the center of the rocking bar and is rectangular in cross-section and is about 0.05 inch in width and about $\frac{1}{8}$ inch in length along the longitudinal centerline thereof. The arms of this embodiment of the flipper form an angle of about 110° with each other, as measured between surfaces 96. Another form of the flipper includes curved surfaces 96 for both arms with the curves of these surfaces matching each other and the curvature of the apex portion so that a single uniform curve is defined between the tips 92 and 94 of the flipper. A straight keeper chamber slot is also defined in this embodiment, and the rear surfaces 98 are planar and oriented to form an angle of about 250° with each other as measured from surface 98 of one arm to surface 98 of the other arm. The keeper chamber in this embodiment is also rectangular and is oriented to be essentially perpendicular to the surface 98 of the leading arm about $\frac{1}{4}$ inch from the rocking bar center. It is noted that even though one end of these straight chambers is located closely adjacent surface 96 of the leading arm, all keeper chambers have closed ends to keep the bar inside the chamber and to prevent interference with movement of the sheet across the flipper.

An automatic reset mechanism can be included on the reset bar 150 to automatically reset the flippers once the last flipper 80L has been uprighted. Such a mechanism can include a spring on the reset rod having a catch operated by flipper 80L and reset by a flange and spring mechanism on the rod 150 when the rod reaches the reset position. A catch means can also be included on the door to keep the door closed during operation of the collator 10.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A collator comprising:

a housing adapted to be associated with a source of sheets to be collated, said housing having a plurality of compartments therein for receiving collated sheets, an access means for permitting access to said compartments, an entranceway defining means for diverting sheets from a source of sheets into said housing, and a sheet chute defining means positioned in said housing to receive sheets from said entranceway;

a plurality of sheet diverter vanes each associated with one of said housing compartments and located to divert sheets from said chute into said associated compartment, each of said sheet diverter vanes having a base portion, a leading arm and a trailing arm each connected to said base portion, a rocker means on said base portion between said arms and rockably connecting each sheet diverter vane to said housing, a diverter vane rocking means movably mounted in said sheet diverter vane adjacent said rocking means, said diverter vane rocking means including a keeper chamber defined in said diverter vane and a weight located in said keeper chamber to be movable from a first position on the trailing arm side of said rocker means across a rocking axis defined by said rocker means to a second position located on the leading arm side of said rocker means, said diverter vanes being positioned adjacent said chute so that said vane leading arms block said sheet chute when said vane rocking means is in said second position and unblock said chute when said vane rocking means is in said first position, said vane rocking means of each diverter vane being moved from said second position to said first position by action of a sheet passing over said each vane from said chute into said associated compartment so that each vane is moved from a chute blocking sheet diverting orientation to a chute clearing orientation after diverting a sheet into an associated compartment so that a plurality of successive sheets are each successively diverted into successive compartments after bypassing the compartment into which a preceding sheet has been diverted; and a reset means for moving said diverter vanes into position to occlude said chute.

2. The collator defined in claim 1 wherein said sheet diverter vanes are V-shaped with an apex portion forming said base portion.

3. The collator defined in claim 2 wherein each of said diverter vanes further includes a guide pin slot receiving said guide pin.

4. The collator defined in claim 3 wherein said reset means includes a reset bar slidably mounted on said housing.

5. The collator defined in claim 3 wherein each diverter vane has planar surfaces on said leading and trailing arms.

6. The collator defined in claim 2 wherein said vane rocking means keeper chamber is arcuate and is defined in said base portion to be located near said rocker means, and said weight includes a bar received in said keeper chamber to be movable therein from one position at one end of said arcuate keeper chamber which corresponds to said vane rocking means first position to another position at another end of said arcuate keeper chamber which corresponds to said vane rocking means second position.

7. The collator defined in claim 1 wherein said access means includes a door.

8. The collator defined in claim 7 wherein said door is translucent.

9. The collator defined in claim 1 wherein said entranceway defining means includes a sheet deflector pivotally mounted on said housing.

10. The collator defined in claim 1 wherein said compartments are downwardly sloped from said sheet diverter vanes.

11. The collator defined in claim 1 wherein said sheet diverter vanes are vertically spaced apart.

* * * * *